US011374340B2

(12) United States Patent
Tang

(10) Patent No.: US 11,374,340 B2
(45) Date of Patent: Jun. 28, 2022

(54) ELECTRICAL CONNECTOR EQUIPPED WITH U-SHAPED REINFORCING MECHANISM ON TOWER OPPOSITE TO EJECTOR

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventor: Wen-Jun Tang, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/953,246

(22) Filed: Nov. 19, 2020

(65) Prior Publication Data

US 2021/0151919 A1 May 20, 2021

(30) Foreign Application Priority Data

Nov. 20, 2019 (CN) ..... 201922017543.5

(51) Int. Cl.
*H01R 12/73* (2011.01)
*H01R 12/70* (2011.01)

(52) U.S. Cl.
CPC ..... *H01R 12/737* (2013.01); *H01R 12/7005* (2013.01)

(58) Field of Classification Search
CPC .. H01R 12/7005; H01R 12/737; H01R 12/52; H01R 12/727; H01R 12/72; H01R 12/73; H01R 12/7023
(Continued)

(56) References Cited

U.S. PATENT DOCUMENTS 5,286,217 A * 2/1994 Liu ..... H01R 12/7011 439/326
5,478,259 A * 12/1995 Noschese ..... H01R 13/658 439/607.31
(Continued)

FOREIGN PATENT DOCUMENTS

CN 203660106 U 6/2014
CN 106299777 A * 1/2017 ..... H01R 12/7005
(Continued)

*Primary Examiner* — Marcus E Harcum
(74) *Attorney, Agent, or Firm* — Ming Chieh Chang; Wei Te Chung

(57) ABSTRACT

A card edge connector includes an insulative elongated housing with two opposite end towers in the longitudinal direction, two rows of contacts disposed in the housing and opposite to each other in the transverse direction perpendicular to the longitudinal direction, and a pair of ejectors rotatably retained to the corresponding end towers, respectively. Each end tower unitarily forms a U-shaped structure for receiving a side edge region of the daughter card. A metallic U-shaped reinforcing piece is assembled upon each U-shaped structure in a compliance manner to directly confront the corresponding side edge of the daughter card in the longitudinal direction while being unexposed from the side edge region of the daughter card in the transverse direction.

9 Claims, 8 Drawing Sheets

(58) Field of Classification Search
USPC ..... 439/157, 372
See application file for complete search history.

(56) References Cited

U.S. PATENT DOCUMENTS

| | | | | |
|---|---|---|---|---|
| 5,620,342 | A * | 4/1997 | Kinross | H01R 13/193 439/630 |
| 5,957,708 | A * | 9/1999 | Lin | H01R 12/7005 439/157 |
| 7,207,815 | B1 * | 4/2007 | Ju | H01R 12/7029 439/159 |
| 7,666,011 | B2 * | 2/2010 | Lim | H05K 7/1405 439/157 |
| 7,677,907 | B2 * | 3/2010 | Guan | H01R 12/721 439/157 |
| 7,828,566 | B2 * | 11/2010 | Chen | H05K 7/1431 439/157 |
| 8,070,499 | B2 * | 12/2011 | Guan | H01R 12/7029 439/155 |
| 8,517,746 | B2 * | 8/2013 | Manickam | H01R 12/7005 439/160 |
| 8,747,133 | B2 * | 6/2014 | Shen | H01R 12/721 439/160 |
| 9,022,809 | B2 * | 5/2015 | Tang | H01R 12/721 439/637 |
| 9,240,639 | B2 * | 1/2016 | Tang | H01R 12/7005 |
| 9,270,063 | B2 * | 2/2016 | Tang | H01R 13/7175 |
| 9,325,090 | B2 * | 4/2016 | Shen | H01R 12/721 |
| 9,397,426 | B2 * | 7/2016 | Li | H01R 12/707 |
| 9,666,971 | B1 * | 5/2017 | Lai | H01R 12/721 |
| 9,806,460 | B2 * | 10/2017 | Li | H01R 13/62955 |
| 9,806,461 | B2 * | 10/2017 | Xu | H01R 12/737 |
| 9,891,386 | B2 * | 2/2018 | Little | G02B 6/00 |
| 9,941,621 | B2 * | 4/2018 | Tang | H01R 12/721 |
| 10,062,991 | B2 * | 8/2018 | Wang | H01R 12/721 |
| 10,177,473 | B2 * | 1/2019 | Bu | H01R 12/721 |
| 10,355,408 | B2 * | 7/2019 | Tanaka | H05K 7/1409 |
| 11,081,827 | B2 * | 8/2021 | Eng-Kan | H01R 13/635 |
| 2011/0117768 | A1 * | 5/2011 | Li | H01R 12/7029 439/345 |
| 2012/0135618 | A1 * | 5/2012 | Shen | H01R 12/721 439/152 |
| 2013/0095679 | A1 * | 4/2013 | Li | H01R 12/7005 439/157 |

FOREIGN PATENT DOCUMENTS

| | | |
|---|---|---|
| CN | 206004071 U | 3/2017 |
| CN | 206789789 U | 12/2017 |

* cited by examiner

ELECTRICAL CONNECTOR EQUIPPED WITH U-SHAPED REINFORCING MECHANISM ON TOWER OPPOSITE TO EJECTOR

BACKGROUND OF THE INVENTION

1. Field of the Invention

The present invention relates generally to an electrical connector, and particularly to the card edge connector having a pair of ejectors on two opposite end towers which are equipped with corresponding U-shaped reinforcing mechanism.

2. Description of Related Arts

U.S. Pat. No. 10,177,473 discloses the card edge connector having the ejector at either end tower. Because the U-shaped structure of the end tower, which receives the side edge region of the daughter card, is relatively thin, thus tending to be broken during insertion or withdrawal of the daughter card with regard to the connector.

It is desired to provide a card edge connector with the superior reinforced U-shaped structure to receive the corresponding side edge region of the daughter card.

SUMMARY OF THE INVENTION

To achieve the above object, a card edge connector includes an insulative elongated housing with two opposite end towers in the longitudinal direction, two rows of contacts disposed in the housing and opposite to each other in the transverse direction perpendicular to the longitudinal direction, and a pair of ejectors rotatably retained to the corresponding end towers, respectively. Each end tower unitarily forms a U-shaped structure for receiving a side edge region of the daughter card. A metallic U-shaped reinforcing piece is assembled upon each U-shaped structure in a compliance manner to directly confront the corresponding side edge of the daughter card in the longitudinal direction while being unexposed from the side edge region of the daughter card in the transverse direction.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
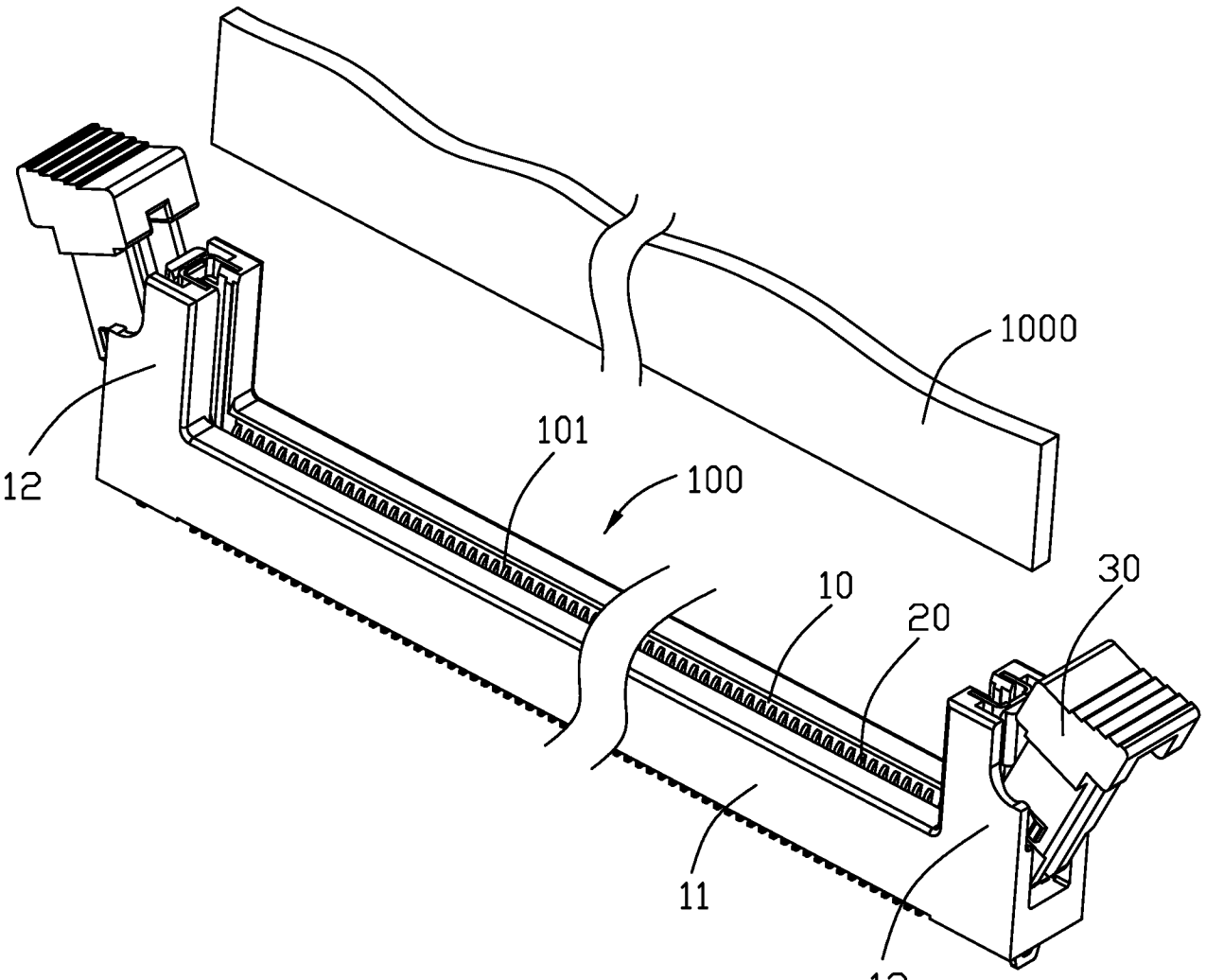
FIG. 1 is a perspective view of an electrical connector according to the first embodiment of the invention.
Figure 2:
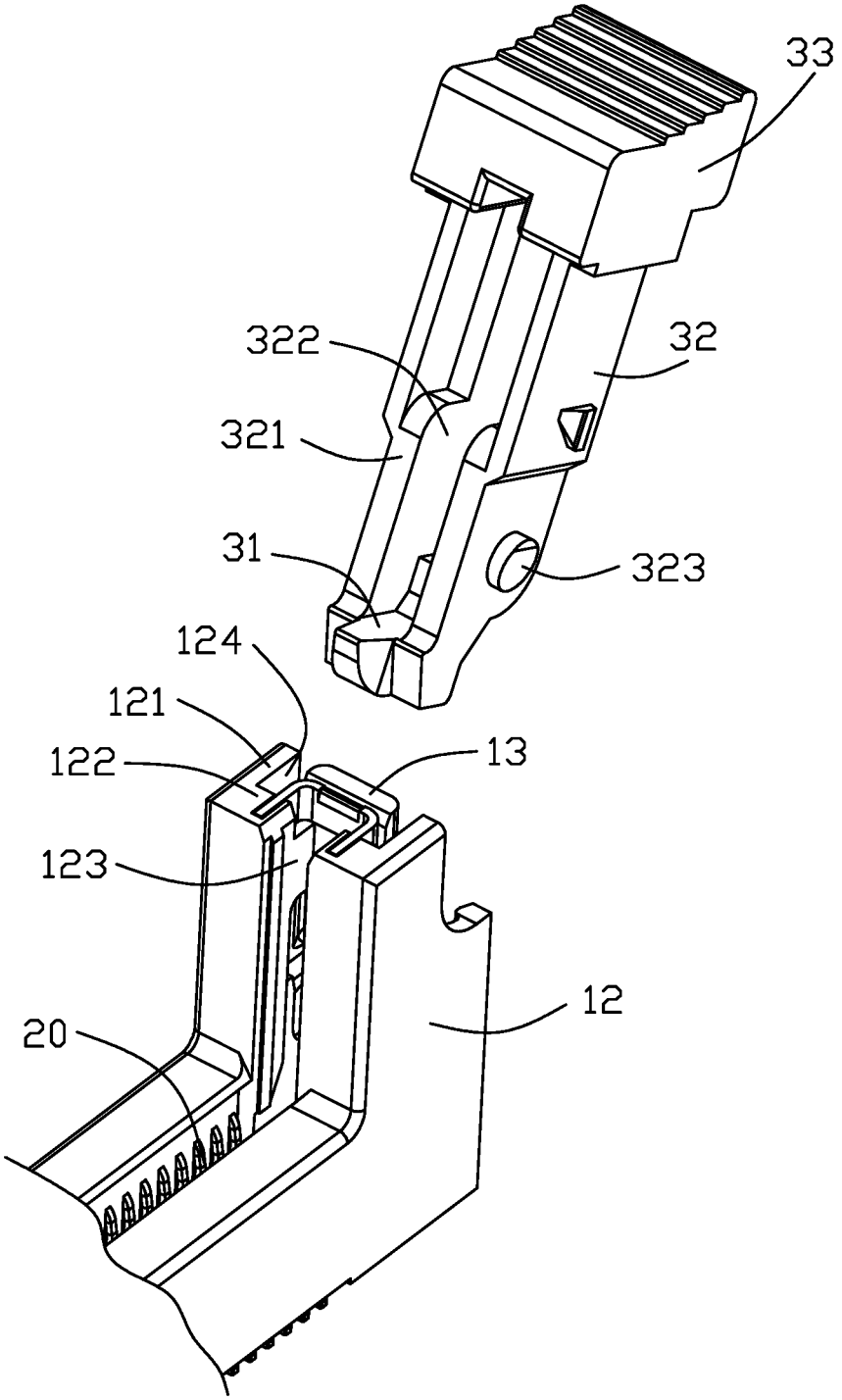
FIG. 2 is an exploded perspective view of a portion of the electrical connector assembly of FIG. 1.
Figure 3:
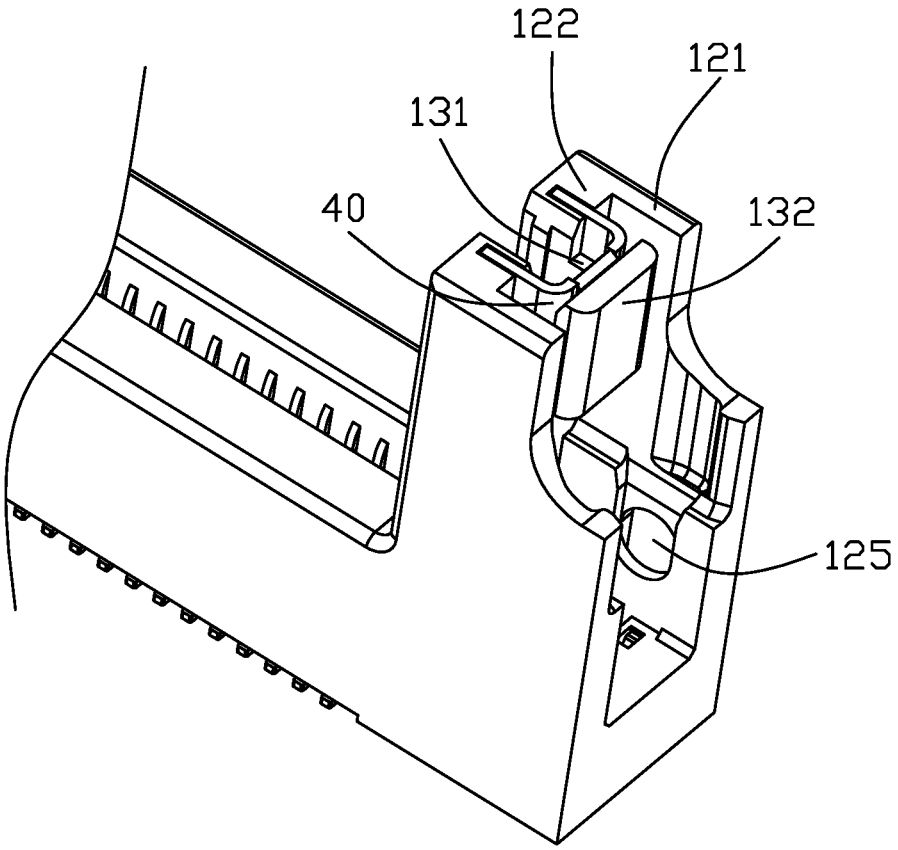
FIG. 3 is another perspective view of the electrical connector of FIG. 2 without showing the corresponding ejector.
Figure 4:
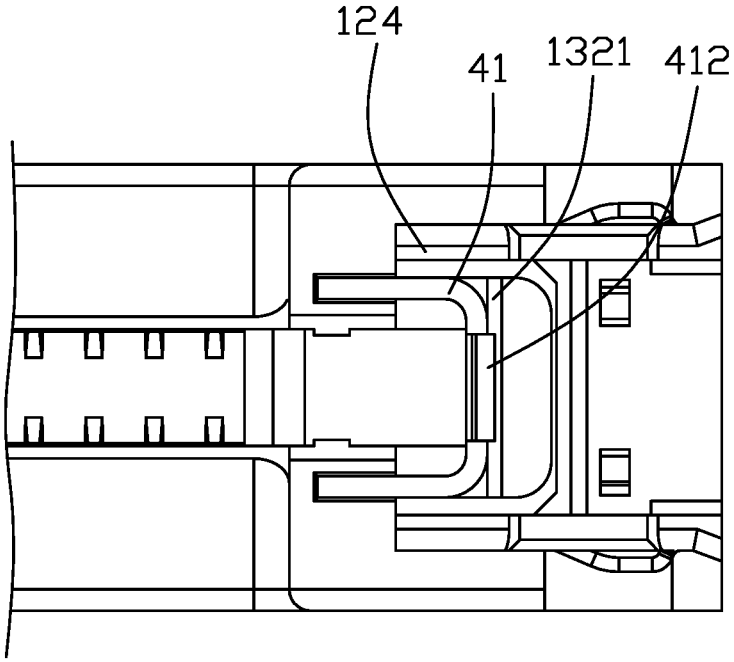
FIG. 4 is a top view of the electrical connector of the electrical connector of FIG. 3.
Figure 5:
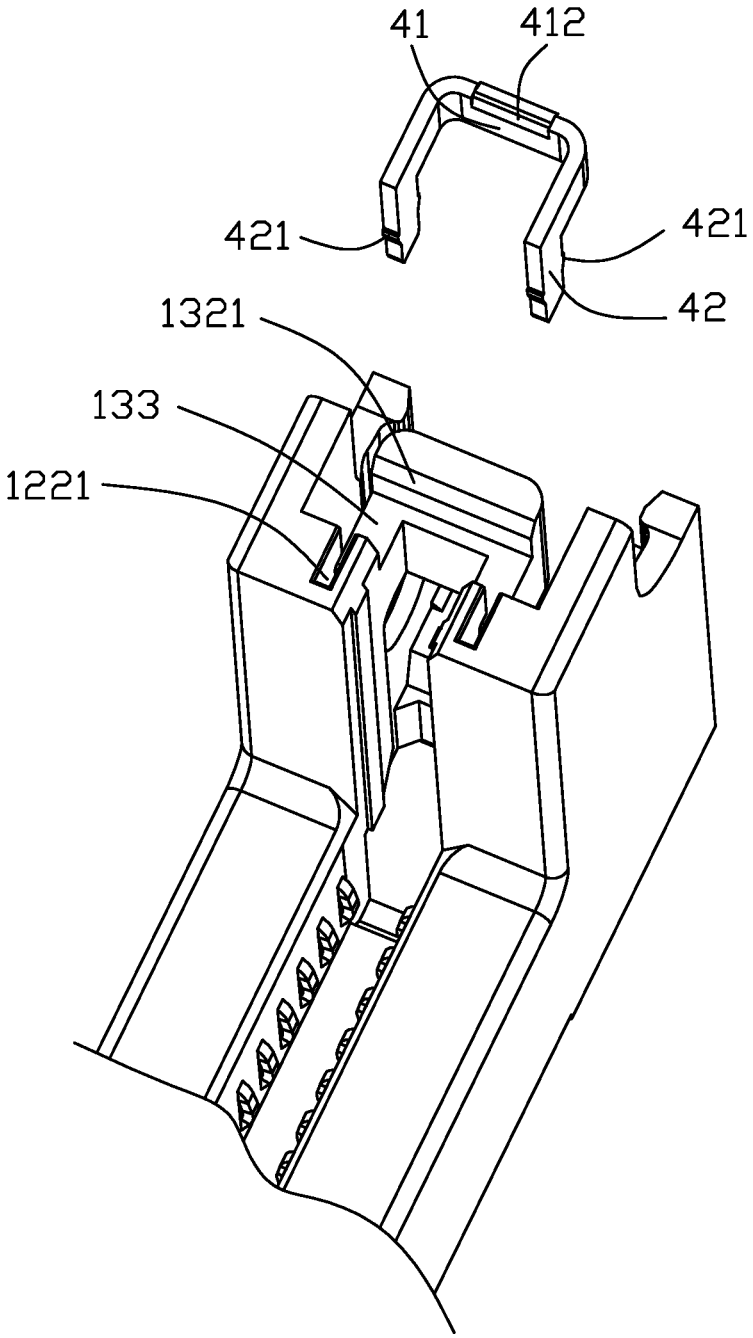
FIG. 5 is an exploded perspective view of the electrical connector of FIG. 3 wherein the U-shaped reinforcing piece is removed away from the tower.

Referring to FIGS. 1-5, an electrical connector 100 includes an insulative elongated housing 10 with a central slot 101 located between side walls 11 and extending along the longitudinal direction, two rows of contacts 20 disposed in the corresponding side walls 11 and located by two sides of the central slot 101 in the transverse direction perpendicular to the longitudinal direction. A pair of ejectors 30 are rotatably retained at two opposite end towers 12, respectively. Each tower 12 includes a pair of side parts 121 coplanar with the corresponding side walls 11, respectively, and a U-shaped structure 13 linked between the pair of side parts 121. Each ejector 30 includes a kicker 31 at the bottom, a locker 33 at the top and a base 32 linked therebetween. The kicker 31 is located below the U-shaped structure 13 while the locker 33 is located above the U-shaped structure 13.

The tower 12 forms an end/thickened part 122 cooperating with the U-shaped structure 13 to form the guiding slot 123, which is located at the end of the central slot 101, for guiding side edge region of the daughter card 1000. The U-shaped structure 13 includes a pair of side portions 131 and an end portion 132. The side portions 131 are connected with the corresponding end part 122 while spaced from the corresponding side parts in a parallel relation. Understandably, the space 124 between the side portion 131 and the corresponding side part 121 is to receive the base 32 when the ejector 30 is in a locked/vertical position in the tower 12.

The feature of the invention is to provide the U-shaped structure 13 with a metallic U-shaped reinforcing piece 40 for preventing breaking. The U-shaped structure 13 forms a platform 133 and the end part 122 forms a pair of retention slots 1221. The U-shaped reinforcing piece 40 includes a U-shaped horizontal section 41 positioned upon the platform 133, and a pair of vertical sections 42 extending downwardly from two opposite free ends of the U-shaped horizontal section 41 and into the corresponding retention slots 1221.

In this embodiment, the vertical section 42 forms barbs 421 for retention consideration. Understandably, the U-shaped reinforcing piece 40 is downwardly assembled to the corresponding U-shaped structure 13 to have the horizontal section 41 positioned upon the platform 133 and the vertical sections 42 within the corresponding retention slots 1221. The horizontal section 41 forms an oblique section 412 abutting against the corresponding oblique portion 1321 of the end portion 132 for guiding the downwardly inserted daughter card during operation.

The side part 121 of the tower 12 forms a pivot hole 125 below the U-shaped structure 13. The base 32 of the ejector 30 forms the pivot 323 to be received within the corresponding pivot hole 125 for rotation of the ejector 30 within the tower 12.

Figure 6:
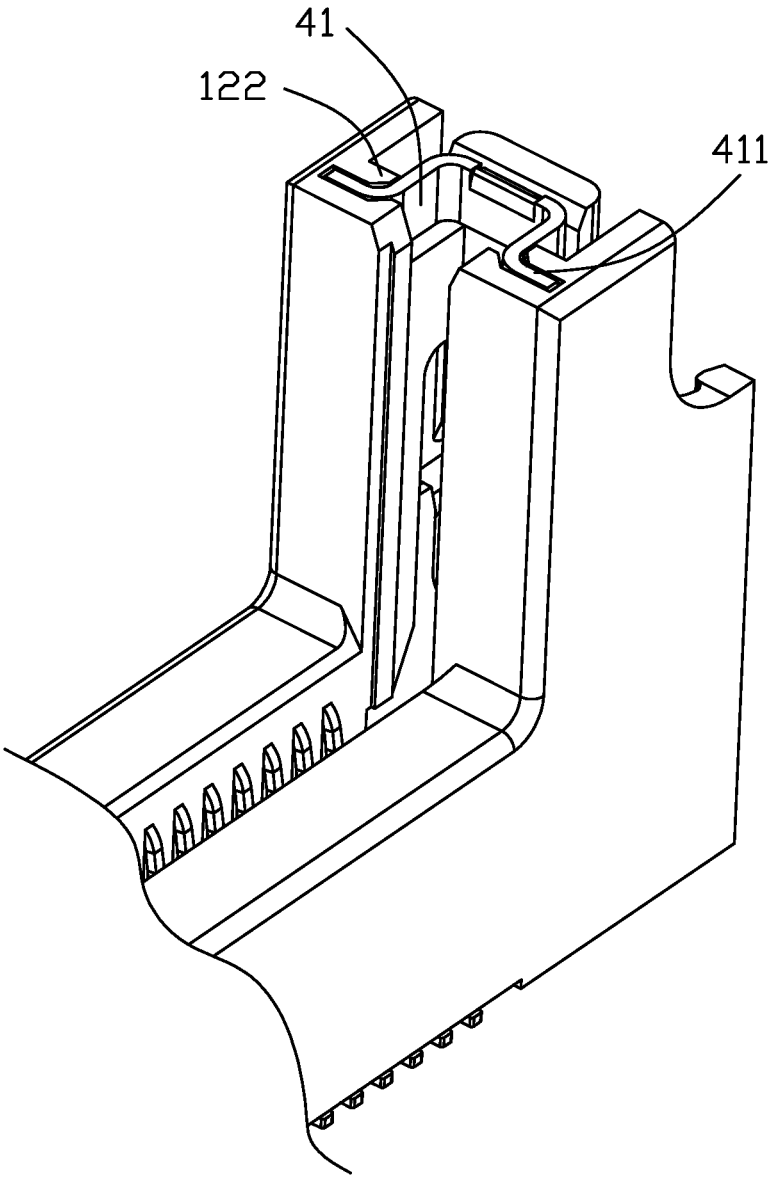
FIG. 6 is a perspective view of a portion of the electrical connector according to the second embodiment of the invention.
Figure 7:
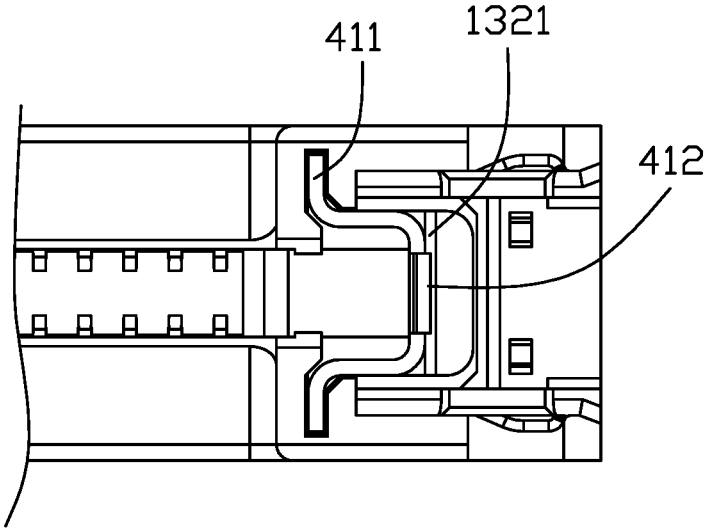
FIG. 7 is atop view of the electrical connector of FIG. 6.
Figure 8:
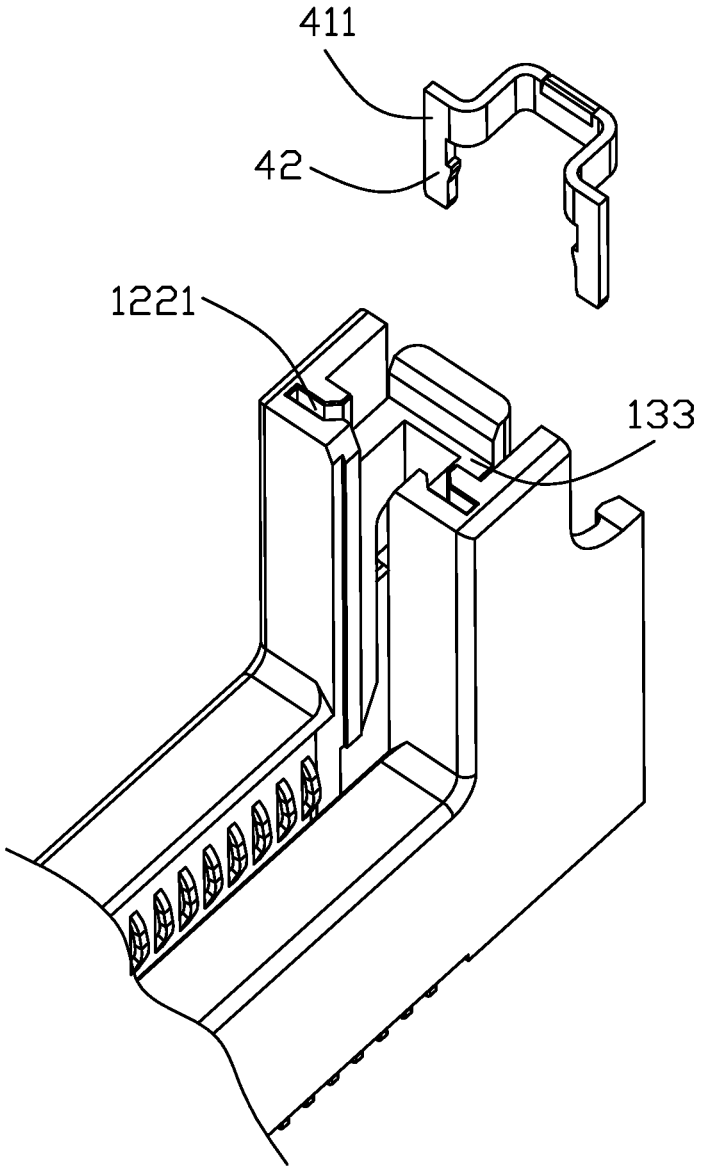
FIG. 8 is an exploded perspective view of the electrical connector of FIG. 6 wherein the U-shaped reinforcing piece is removed away from the tower.

FIGS. 6-8 show the second embodiment of the invention wherein the pair of vertical sections 42 extend in the transverse direction instead of the longitudinal direction, compared with those in the first embodiment.

Understandably, the invention is to provide the U-shaped structure 13 of the tower 12 with the metallic U-shaped reinforcing piece 40 in a compliance manner wherein the horizontal section 41 confronts the side edge of the daughter card 1000 in the longitudinal direction while the vertical sections 42 are hidden within the end part 122 and unexposed to the daughter card 1000.

Although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. An electrical connector for use with a daughter card, comprising:

an insulative housing including a pair of side walls extending in a longitudinal direction, a central slot formed between the pair of side walls in a transverse direction perpendicular to the longitudinal direction for receiving the daughter card;

two rows of contacts disposed in the corresponding side walls, respectively;

a pair of towers located at two opposite ends of the housing in the longitudinal direction;

a pair of ejectors rotatably disposed in the corresponding towers, respectively;

each tower including a pair of side parts and an end part between the pair of side parts, and a U-shaped structure linked to the end part to commonly form a guiding slot, which communicates with the central slot, for receiving a side edge region of the daughter card; wherein each U-shaped structure is equipped with a metallic U-shaped reinforcing piece in compliance manner;

the U-shaped reinforcing piece includes a U-shaped horizontal section and a pair of vertical sections downwardly extending from two opposite free ends of the horizontal section;

the U-shaped horizontal section is exposed toward the guiding slot in the longitudinal direction;

the U-shaped horizontal section forms an oblique section for confronting a side edge of the daughter card; and the U-shaped structure forms an oblique portion against which the oblique section abuts.

2. The electrical connector as claimed in claim 1, wherein the end part forms a pair of retention slots to receive the corresponding vertical sections.

3. The electrical connector as claimed in claim 1, wherein the vertical section extends in the longitudinal direction.

4. The electrical connector as claimed in claim 1, wherein the vertical section extends in the transverse direction.

5. The electrical connector as claimed in claim 1, wherein the vertical sections are not exposed to the guiding slot in the transverse direction.

6. The electrical connector as claimed in claim 1, wherein the U-shaped structure forms a platform on which the horizontal section is downwardly positioned.

7. The electrical connector as claimed in claim 1, wherein the U-shaped structure includes a pair of side portions linked to the end part, and an end portion linked between the pair of side portions and supporting the U-shaped horizontal section in the longitudinal direction.

8. The electrical connector as claimed in claim 7, wherein in each tower, the ejector and the U-shaped horizontal section of the U-shaped reinforcing piece are located by two sides of the end portion of the U-shaped structure in the longitudinal direction.

9. The electrical connector as claimed in claim 1, wherein the side parts are coplanar with the corresponding side walls, respectively, in the longitudinal direction.

* * * * *